US008704067B2

(12) United States Patent
Fujita

(10) Patent No.: US 8,704,067 B2
(45) Date of Patent: Apr. 22, 2014

(54) MUSICAL SCORE PLAYING DEVICE AND MUSICAL SCORE PLAYING PROGRAM

(71) Applicant: Kabushiki Kaisha Kawai Gakki Seisakusho, Hamamatsu (JP)

(72) Inventor: Akihiro Fujita, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 13/868,008

(22) Filed: Apr. 22, 2013

(65) Prior Publication Data

US 2013/0276619 A1 Oct. 24, 2013

(30) Foreign Application Priority Data

Apr. 24, 2012 (JP) ..... 2012-098803
Apr. 24, 2012 (JP) ..... 2012-098804

(51) Int. Cl.
*A63H 5/00* (2006.01)
*G04B 13/00* (2006.01)
*G10H 7/00* (2006.01)

(52) U.S. Cl.
USPC ..... 84/609

(58) Field of Classification Search
USPC ..... 84/609
See application file for complete search history.

(56) References Cited

U.S. PATENT DOCUMENTS

| | | | | |
|---|---|---|---|---|
| 6,235,979 | B1 * | 5/2001 | Yanase | 84/477 R |
| 7,314,992 | B2 * | 1/2008 | Funaki et al. | 84/611 |
| 8,093,481 | B2 * | 1/2012 | Bignell et al. | 84/477 R |
| 2006/0219089 | A1 * | 10/2006 | Funaki et al. | 84/611 |
| 2011/0120288 | A1 * | 5/2011 | Bignell et al. | 84/483.1 |

FOREIGN PATENT DOCUMENTS

| | | |
|---|---|---|
| JP | 7-129159 | 5/1995 |

* cited by examiner

*Primary Examiner* — Jeffrey Donels
(74) *Attorney, Agent, or Firm* — Christie, Parker & Hale, LLP

(57) ABSTRACT

A musical score playing device including a prescribed measure time calculating module; a measure playing time calculating module; a comparing module for comparing the calculated prescribed measure time and the measure playing time; and a note value correcting module for inferring that a tuplet is present within the measure if the prescribed measure time and the measure playing time are not matched and for correcting the sound emission timings, the note value correcting module including a measure note sequence recording module for storing a note sequence, a grouping module for grouping the notes within the measure according to each beat, and a tupleting process module for changing the note values of the grouped notes based on a relationship of the playing time of the grouped notes and the reference time of a single beat.

20 Claims, 18 Drawing Sheets

| NOTE No. (FROM THE UPPER LEFT) | CATEGORY | MUSIC INTERVAL (hex) | ChordID | TimingNo. | GateTime | OnTime |
|---|---|---|---|---|---|---|
| 1 | NOTE | 43 | 1 | 1 | 240 | 0 |
| 2 | NOTE | 43 | 2 | 2 | 240 | 240 |
| 3 | REST | | 3 | 3 | 240 | 480 |
| 4 | NOTE | 43 | 4 | 4 | 240 | 720 |
| 5 | REST | | 5 | 5 | 120 | 960 |
| 6 | NOTE | 43 | 6 | 6 | 120 | 1080 |
| 7 | REST | | 7 | 7 | 120 | 1200 |
| 8 | NOTE | 43 | 8 | 8 | 120 | 1320 |
| 9 | NOTE | 43 | 9 | 9 | 360 | 1440 |
| 10 | NOTE | 43 | 11 | 11 | 120 | 1800 |
| NOTE No. (FROM THE UNDER LEFT) | CATEGORY | MUSIC INTERVAL (hex) | ChordID | TimingNo. | GateTime | OnTime |
| 11 | NOTE | 30 | 1 | 1 | 480 | 0 |
| 12 | REST | | 3 | 3 | 480 | 480 |
| 13 | NOTE | 30 | 5 | 5 | 360 | 960 |
| 14 | NOTE | 30 | 8 | 8 | 120 | 1320 |
| 15 | NOTE | 30 | 9 | 9 | 240 | 1440 |
| 16 | NOTE | 30 | 10 | 10 | 240 | 1680 |

| EVENT TYPE |
| --- |
| DATA 1 |
| DATA 2 |
| TIME INFORMATION |
| CHANNEL NUMBER |

Fig.14

| NOTE No. (FROM THE UPPER LEFT) | CATEGORY | MUSIC INTERVAL (hex) | ChordID | TimingNo. | GATETIME BEFORE CONVERSION | GATETIME AFTER CONVERSION | ON TIME BEFORE CONVERSION | ON TIME AFTER CONVERSION | BEAM ID |
|---|---|---|---|---|---|---|---|---|---|
| 1 | NOTE | 48 | 1 | 1 | 240 | 240 | 0 | 0 | 1 |
| 2 | NOTE | 48 | 2 | 2 | 240 | 240 | 240 | 240 | 1 |
| 3 | NOTE | 48 | 3 | 3 | 120 | 80 | 480 | 480 | 2 |
| 4 | NOTE | 48 | 4 | 4 | 120 | 80 | 600 | 560 | 2 |
| 5 | NOTE | 48 | 5 | 5 | 120 | 80 | 720 | 640 | 2 |
| 6 | NOTE | 48 | 6 | 6 | 120 | 120 | 840 | 720 | 3 |
| 7 | NOTE | 48 | 7 | 7 | 120 | 120 | 960 | 840 | 3 |
| 8 | NOTE | 48 | 8 | 8 | 240 | 160 | 1080 | 960 | 4 |
| 9 | REST | | 9 | 9 | 240 | 160 | 1320 | 1120 | 0 |
| 10 | NOTE | 48 | 10 | 10 | 240 | 160 | 1560 | 1280 | 4 |
| 11 | REST | | 11 | 11 | 240 | 240 | 1800 | 1440 | 0 |
| 12 | NOTE | 48 | 12 | 12 | 240 | 240 | 2040 | 1680 | 0 |
| NOTE No. (FROM THE UNDER LEFT) | | | | | | | | | |
| 13 | NOTE | 30 | 1 | 1 | 480 | 480 | 0 | 0 | 0 |
| 14 | NOTE | 30 | 3 | 3 | 240 | 240 | 480 | 480 | 0 |
| 15 | NOTE | 30 | 6 | 6 | 240 | 240 | 840 | 720 | 0 |
| 16 | NOTE | 30 | 8 | 8 | 960 | 960 | 1080 | 960 | 0 |

Fig.20

| NOTE No. | CATEGORY | MUSIC INTERVAL (hex) | ChordID | TimingNo. | GATETIME BEFORE CONVERSION | GATETIME AFTER CONVERSION | ON TIME BEFORE CONVERSION | ON TIME AFTER CONVERSION |
|---|---|---|---|---|---|---|---|---|
| 1 | NOTE | 48 | 1 | 1 | 480 | 320 | 0 | 0 |
| 2 | NOTE | 48 | 2 | 2 | 480 | 320 | 480 | 320 |
| 3 | NOTE | 48 | 3 | 3 | 480 | 320 | 960 | 640 |
| 4 | NOTE | 48 | 4 | 4 | 960 | 960 | 1440 | 960 |

Fig.23

| NOTE No. | CATEGORY | MUSIC INTERVAL (hex) | ChordID | TimingNo. | GATETIME BEFORE CONVERSION | GATETIME AFTER CONVERSION | ON TIME BEFORE CONVERSION | ON TIME AFTER CONVERSION |
|---|---|---|---|---|---|---|---|---|
| 1 | NOTE | 48 | 1 | 1 | 960 | 640 | 0 | 0 |
| 2 | NOTE | 48 | 2 | 2 | 480 | 320 | 960 | 640 |
| 3 | NOTE | 48 | 3 | 3 | 480 | 320 | 1440 | 960 |
| 4 | NOTE | 48 | 4 | 4 | 480 | 320 | 1960 | 1280 |
| 5 | NOTE | 48 | 5 | 5 | 480 | 320 | 2400 | 1600 |

MUSICAL SCORE PLAYING DEVICE AND MUSICAL SCORE PLAYING PROGRAM

CROSS-REFERENCE TO RELATED APPLICATION

This application claims priority to and the benefit of Japanese Patent Application Nos. 2012-098803 and 2012-098804, filed in the Japanese Patent Office on Apr. 24, 2012, the entire contents of which are incorporated herein by reference.

TECHNICAL FIELD

The present invention relates to a musical score playing art of playing music from musical information of an electronically acquired musical score and particularly relates to a musical score playing device and a musical score playing program by which, in a process of determining note values from note shapes written in a musical score, correct note values can be determined even if tuplet symbols are not written.

The present invention also relates to a musical score playing device and a musical score playing program specialized to determine correct note values when tuplet symbols for triplets are not written.

BACKGROUND

A musical score playing device prepares playing information from musical score information, such as written positions of notes, sound emission starting timings and durations, written positions of bar lines, etc., extracted from a musical score file in PDF or a musical score acquired by a scanner, and plays music automatically in accordance with the playing information. A procedure for extracting musical score information from a musical score and preparing playing information is, for example, described in Patent Document 1.

A note value (duration of a note) of a triplet, quintuplet, etc., in a musical score differs from the duration indicated by the actually written note. For example, when as indicated in the arrowed portion in the first measure in FIG. 25, a triplet note is denoted by an eighth note, its duration is ⅔ of an eighth note.

SUMMARY OF INVENTION

When, in a case where note values are determined from shapes of written notes to generate playing information from a musical score, there is a tuplet symbol (a numeral indicating a tuplet) that indicates a triplet as in the arrowed portion in the first measure in FIG. 25, the correct note value can be determined as long as the symbol (numeral) can be recognized. However, in many cases, the tuplet symbol is omitted as in the arrowed portion in the third measure in FIG. 25, and in such a case, the note value is determined as a normal eighth note in reading the musical score and preparing the playing information.

Also, even if the tuplet symbols are written, finger numbers, etc., are written in a musical score in many cases, and the finger numbers and the tuplet symbols (numerals indicating the tuplets) must be distinguished in the process of generating the playing information from the musical score and a reading art for this purpose was thus necessary.

A musical score playing device and a musical score playing program by which, even if tuplet symbols are not written in a musical score, playing information having the correct note values can be prepared to enable automatic playing.

A musical score playing device comprising: a prescribed measure time calculating means calculating a prescribed measure time from the meter of a musical composition; a measure playing time calculating means calculating a measure playing time from sound emission timings and note values of notes and rests within a measure; a comparing means comparing the calculated prescribed measure time and measure playing time; and a note value correcting means inferring that a tuplet is present within the measure if the prescribed measure time and the measure playing time are not matched and correcting the sound emission timings and note values of the notes and rests; and wherein the note value correcting means includes a measure note sequence recording means storing a note sequence within the measure, a grouping means grouping the notes within the measure according to each beat, and a tupleting process means performing a tupleting process of changing the note values of the grouped notes if a playing time of the grouped notes and a reference time of a single beat that is calculated from the note sequence are not matched.

A musical score playing program for making a computer execute a prescribed measure time calculating step of calculating a prescribed measure time from the meter of a musical composition, a measure playing time calculating step of calculating a measure playing time from sound emission timings and note values of notes and rests within a measure, a comparing step of comparing the calculated prescribed measure time and measure playing time, and a note value correction step, in which, if the prescribed measure time and the measure playing time are not matched, it is inferred that a tuplet is present within the measure, a note sequence within the measure is stored, the notes within the measure are grouped according to each beat, and if a playing time of the grouped notes and a reference time of a single beat that is calculated from the note sequence are not matched, a tupleting process of changing the note values of the grouped notes is performed to correct the sound emission timings and note values of the notes and rests.

The present invention also relates to a musical score playing device and a musical score playing program specialized to determine correct note values when tuplet symbols for triplets are not written.

A musical score playing device comprising: a prescribed measure time calculating means calculating the prescribed measure time from the meter of a musical composition; a measure playing time calculating means calculating a measure playing time from sound emission timings and note values of notes and rests within a measure; a first comparing means comparing the calculated prescribed measure time and measure playing time; and a note value correcting means inferring that a tuplet is present within the measure if the prescribed measure time and the measure playing time are not matched and correcting the sound emission timings and note values of the notes and rests; and wherein the note value correcting means includes a target note determining means that successively determines a correction target note, a tupleting process means performing a tupleting process of changing the note value of each correction target note in the measure to ⅔, and a second comparing means comparing the prescribed measure time and a corrected measure playing time that is in accordance with the changed note values, and the tupleting process and the comparison by the second comparing means are repeated for the respective target notes and the tupleting of a triplet is finalized with the changed note values of the respective notes at the point at which the prescribed measure time and the corrected measure playing time are equal.

A musical score playing method comprising: a prescribed measure time calculating step of calculating the prescribed measure time from the meter of a musical composition; a measure playing time calculating step of calculating the measure playing time from sound emission timings and note values of notes and rests within a measure; a tuplet inference step of comparing the calculated prescribed measure time and measure playing time and, if the prescribed measure time and the measure playing time are not matched, inferring that a tuplet is present within the measure; a target note determining step of determining a correction target note with respect to the notes in the measure; and a tupleting process step of performing a tupleting process of changing the note value of the correction target note in the measure to ⅔, comparing the prescribed measure time and a corrected measure playing time that is in accordance with the changed note values, and finalizing the tupleting of a triplet with the changed note values of the respective notes at the point at which the prescribed measure time and the corrected measure playing time are equal; and making a computer perform the tupleting process repeatedly on the respective target notes.

With the musical score playing device and the musical score playing program according to the present invention, even if tuplet symbols are not written in a musical score, if the prescribed measure time and the measure playing time do not match, it is inferred that there is a tuplet portion in the measure and the tupleting process of correcting the sound emission timings and note values of notes and rests is performed to enable playing information having correct note values to be prepared.

If the playing time of grouped notes is longer than the reference time of one beat and there is no note longer than the reference time within the group, or if there is a note longer than the reference time among the grouped notes and the playing time exceeds twice the reference time, or if the playing time of the grouped notes is shorter than the reference time of one beat and the number of notes in the group is 3, the tupleting process is performed by changing the note values of respective notes that have been grouped.

With the tupleting process specialized to triplets, the note values of the correction target notes in a measure are changed to ⅔ and the target notes for which the prescribed measure time becomes equal to the corrected measure playing time are judged to be tuplet notes to be corrected in note value to enable the tupleting process specialized to triplets, which are most frequently used in musical scores, to be performed.

Also, in determining the correction target notes by means of the target note determining means, tuplet inference is performed in the order from a sixty-fourth note to a half note (from small note values) to enable a tupleting process of high efficiency to be performed in musical compositions in which tuplets of notes of small note value tend to be used frequently.

BRIEF DESCRIPTION OF DRAWINGS

FIG. 14 is a table of playing information in a case of performing the tuplet inference process on the respective notes of the musical score example.

FIG. 20 is a table of playing information in a case of performing the tuplet inference process on the respective notes of the musical score example.

FIG. 23 is a table of information in a case of performing the tuplet inference process on the respective notes of the musical score example.

DESCRIPTION OF EMBODIMENTS

A musical score playing device according to the present invention shall now be described with reference to the drawings.

Figure 1:
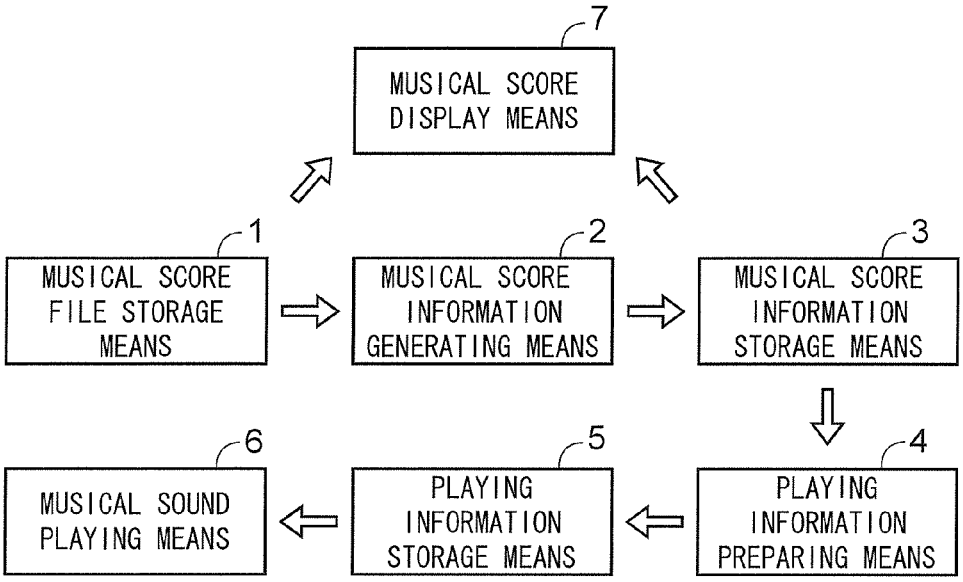
FIG. 1 is a block diagram of functions of an automatic playing device incorporating a musical score playing device according to an embodiment of the present invention.

FIG. 1 is a block diagram of an automatic playing device operating on a computer and incorporating the musical score playing device (musical score playing program) according to the present invention.

The automatic playing device includes a musical score file storage means 1 storing musical score files and PDF musical score files resulting from scanning of musical scores, a musical score information generating means 2 recognizing a musical score file and generating musical score information, a musical score information storage means 3 storing the generated musical score information, a playing information preparing means 4 preparing playing information from the musical score information, a playing information storage means 5 storing the generated playing information, a musical sound playing means 6 reading the playing information successively and actually playing music, and a musical score display means 7 displaying the musical score files and the musical score information.

A characteristic arrangement of the present invention is that when the playing information is prepared from the musical score information in the playing information preparing means 4, inference of tuplets is performed to determine correct note values, and a tuplet inference program that is necessary for this purpose functions as a portion of the playing information preparing means 4.

Figure 2:
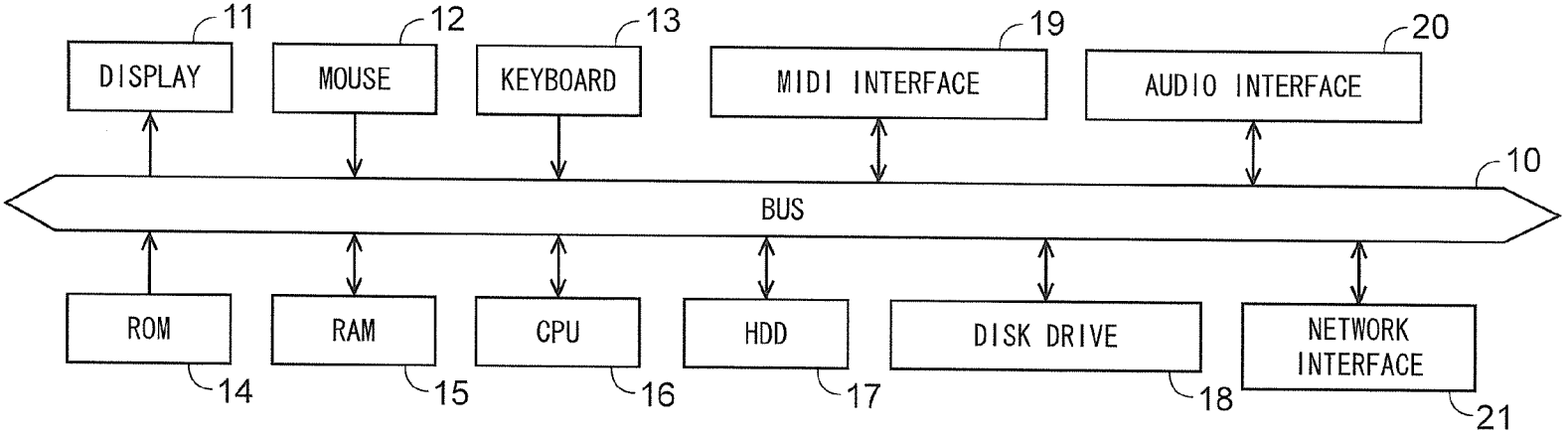
FIG. 2 is a block diagram of a hardware arrangement example of the automatic playing device.

The hardware of the automatic playing device may be realized by a general purpose information processing device, such as a personal computer, etc. FIG. 2 is a block diagram of a hardware arrangement example of the automatic playing device that is constructed on a computer and is arranged by connecting a display 11, a mouse 12, a keyboard 13, a ROM 14, a RAM 15, a CPU 16, an HDD 17, a disk drive 18, a MIDI interface 19, an audio interface 20, and a network interface 21 to a bus 10.

In the HDD 17 of the computer, the musical score playing program, for acquiring a musical score file via the MIDI interface 19, the audio interface 20, or the network interface 21 and preparing playing information to perform automatic playing, is installed from a recording medium installed in the disk drive 18 or is downloaded from a predetermined URL via the internet.

The CPU 16 executes various types of processes (respective steps) in accordance with the predetermined program (musical score playing program) installed or downloaded by the abovementioned procedure and thereby controls the entirety of the musical score playing device. The CPU 16 includes the musical score file storage means 1, the musical score information generating means 2, and the musical score information storage means 3 as principal functions to store the acquired musical score information as electronic information and enable display of the stored information on the musical score display means 7, and includes the playing information preparing means 4, the playing information storage means 5, and the musical sound playing means 6 to enable automatic playing of musical sounds in accordance with the playing information generated in accordance with the musical score information.

The RAM 15 temporarily stores information used in the processes of the CPU 16.

The musical score file storage means 1 is arranged from the RAM 15 and the HDD 17. The musical score file may be acquired from the network interface 21, etc., as mentioned above or may be acquired by connecting a separate image scanner to the computer.

The musical score information generating means 2 is arranged from the program stored in the HDD 17, the CPU 16 that executes the program, the RAM 15 used as a working storage area, etc.

The musical score information storage means 3 is arranged from the RAM 15 and the HDD 17.

The playing information generating means 4 is arranged from the program stored in the HDD 17, the CPU 16 that executes the program, the RAM 15 used as a working storage area, etc.

The playing information storage means 5 is arranged from the RAM 15 and the HDD 17.

The musical sound playing means 6 includes the musical score playing program stored in the HDD 17, the CPU 16 that executes the program, the RAM 15 used as a working storage area, a sound source device, the audio interface 20, etc. The sound source device includes a sound system that includes a D/A converter, an amp, and a speaker.

The musical score display means 7 is arranged from the program stored in the HDD 17, the CPU 16 that executes the program, the RAM 15 used as a working storage area, the display 11, which is a liquid crystal display, etc.

Figure 3:
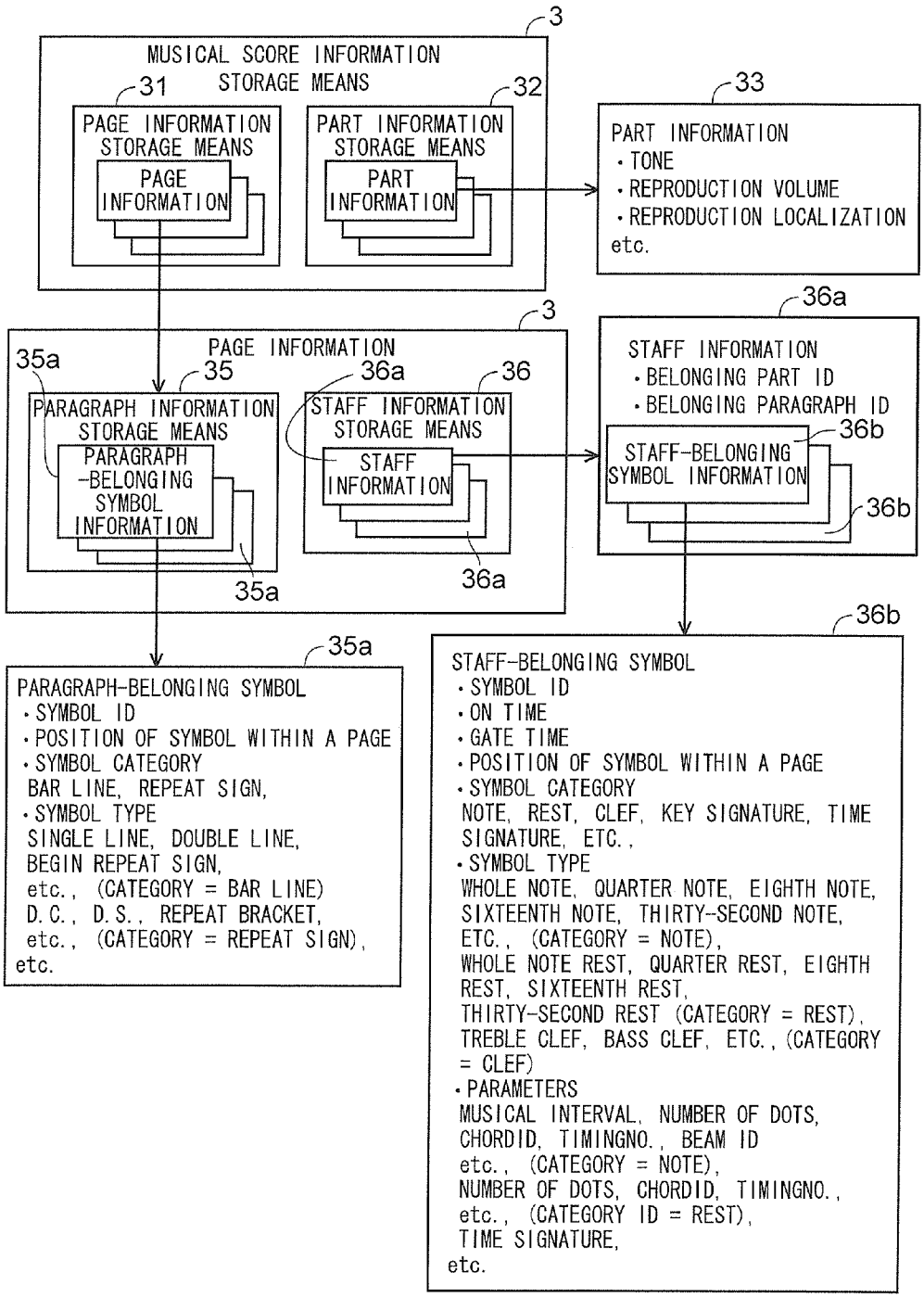
FIG. 3 is a model diagram for describing details of information stored by a musical information storage means.

As shown in FIG. 3, the musical score information storage means 3 includes a page information storage means 31 and a part information storage means 32. The part information storage means 32 is arranged as a sequence of part information 33 corresponding to the number of parts. Each part information 33 includes tone, reproduction volume, reproduction localization information, etc. In the page information storage means 31 is recorded a sequence of page information 34 corresponding to the number of pages. Each page information 34 includes at least a paragraph information storage means 35 and a staff information storage means 36.

In the paragraph information storage means 35 is recorded a sequence of paragraph-belonging symbol information **35*a* that is effective in common for all parts or all staffs belonging to a certain paragraph. For a paragraph-belonging symbol recorded in each paragraph-belonging symbol information 35*a***, a symbol ID unique within the paragraph, symbol category information, symbol type information, parameter sequence in accordance with the symbol category and symbol type, position of symbol within a page, etc., are included. As examples of symbol categories, repeat sign, bar line, etc., can be cited. As examples of symbol types, D.C., D.S., repeat bracket, etc., (category=repeat sign), and single line, double line, begin repeat sign, end repeat sign, double bar line, etc., (category=bar line) can be cited.

In the staff information storage means 36 is recorded a sequence of staff information **36*a* corresponding to the number of staffs within a page. Each staff information 36*a* includes a belonging part ID, belonging paragraph ID, staff-belonging symbol information 36*b*, etc. The staff-belonging symbol information 36*b*** is recorded as a sequence of staff-belonging symbols belonging to the corresponding staff.

For a staff-belonging symbol recorded in the staff-belonging symbol information **36*b***, a symbol ID unique within the paragraph, symbol category information, symbol type information, OnTime, GateTime, parameter sequence in accordance with the symbol category and symbol type, position of symbol within a page (coordinates having an upper left position of a page as an origin), etc., are included.

As examples of symbol categories, note, rest, time signature, clef, key signature, accidental, etc., can be cited.

As examples of symbol type information, whole note, quarter note, eighth note, sixteenth note, thirty-second note, etc., (category=note), whole note rest, quarter rest, eighth rest, sixteenth rest, thirty-second rest (category=rest), and treble clef, bass clef, etc., (category=clef) can be cited.

As examples of parameters, musical interval (Note No. in MIDI), number of dots, ChordID, TimingNo., beam ID etc., (category=note), number of dots, ChordID, TimingNo., etc., (category ID=rest), ChordID (ID of group of notes sounded at the same timing), TimingNo. (number indicating order of sound emission), GateTime (value indicating duration of a note or rest), OnTime (time from head of measure to start of sound emission), etc., can be cited.

Figure 4:
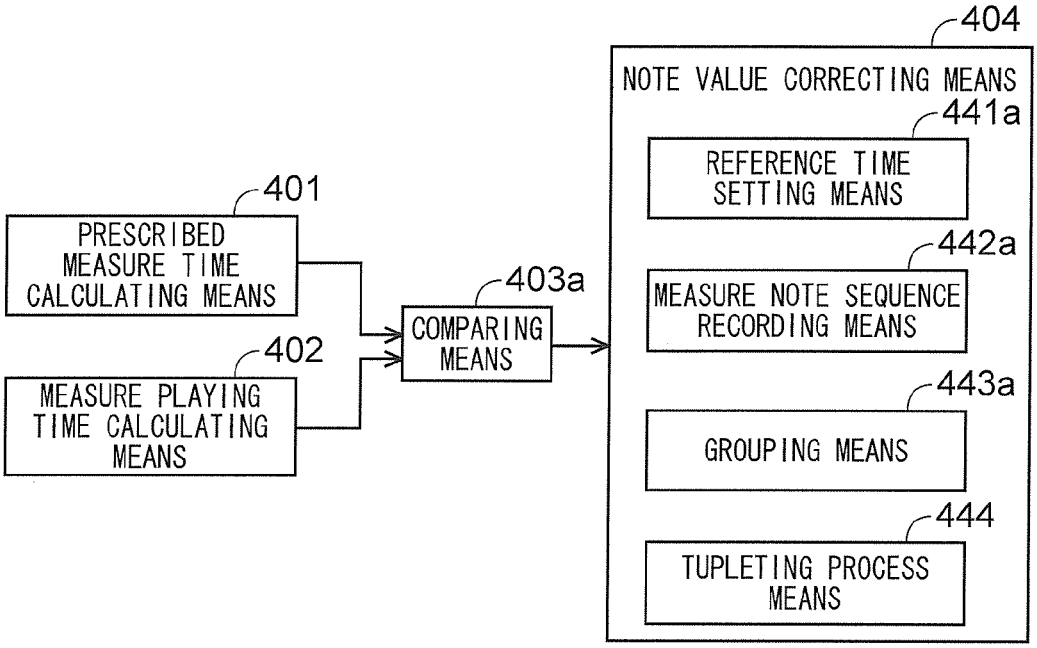
FIG. 4 is a functional block diagram of an arrangement of a playing information preparing means.

As shown in FIG. 4, the playing information preparing means 4 includes a prescribed measure time calculating means 401 calculating a prescribed measure time from the meter of a musical composition, a measure playing time calculating means 402 calculating a measure playing time from sound emission timings and note values (GateTime) of notes and rests within a measure, a comparing means **403*a* comparing the calculated prescribed measure time and measure playing time, and a note value correcting means 404** inferring that a tuplet is present within the measure if the prescribed measure time and the measure playing time are not matched and correcting the sound emission timings and note values of the notes and rests.

The note value correcting means 404 includes a reference time setting means 441*a* setting a reference time that is the time of a single beat in the musical score, a measure note sequence recording means 442*a* storing a note sequence within the measure, a grouping means 443*a* grouping the notes within the measure according to each beat, and a tupleting process means 444 performing a tupleting process of changing the note values of the grouped notes based on a relationship of the playing time of the grouped notes and the reference time of a single beat that is calculated from the note sequence.

Figure 5:
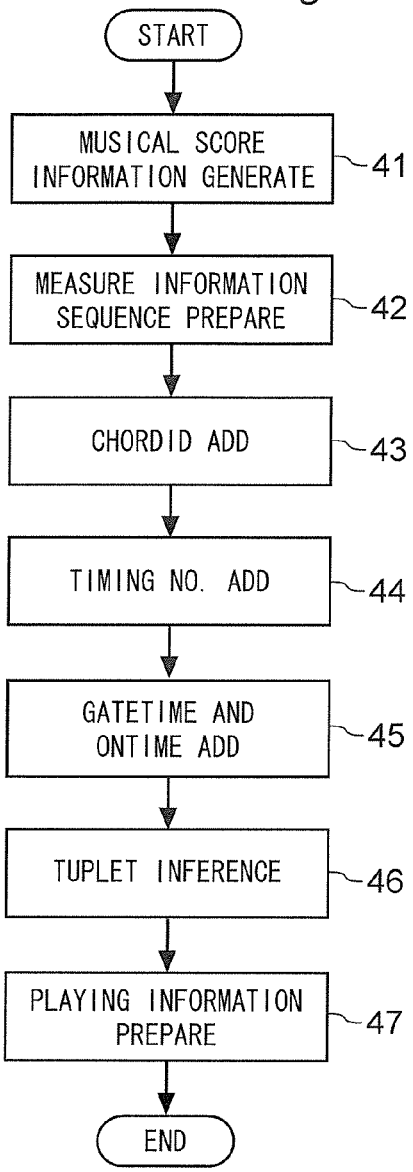
FIG. 5 is a flowchart of a procedure for preparing playing information by the playing information preparing means.

An overall procedure for musical score preparation by the musical score playing device shall now be described with reference to the flowchart of FIG. 5.

First, the musical score information is generated by the musical score information generating means 2 (step 41). The musical score information generating means 2 reads a musical score file from the musical score file storage means 1 and from the writing information contained in the file, the page information, part information, paragraph information, paragraph-belonging symbol information, staff information, and staff-belonging symbol information are generated in accordance with generally-known conventional arts. However, the ChordID, TimingNo., GateTime, and OnTime of the staff-belonging symbol information are provided by the playing information preparing means 4.

The generated musical score information is recorded in the musical score information storage means 3.

Thereafter, the playing information is prepared by the procedure of step 42 to step 46 by the playing information generating means 4.

Figure 6:
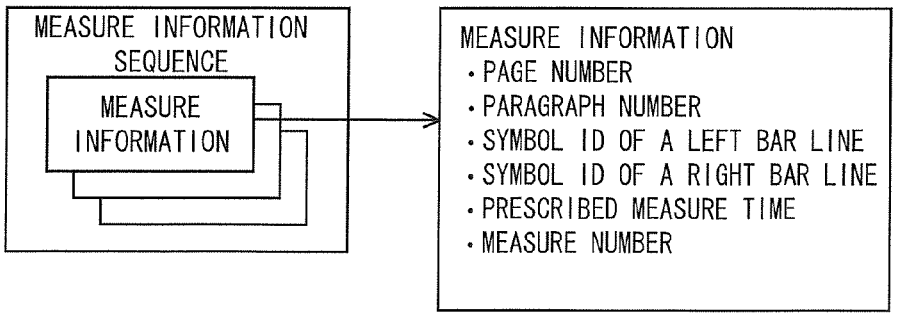
FIG. 6 is a model diagram of an example of a measure information sequence.

In step 42, a measure information sequence, such as that shown in FIG. 6, is prepared. Each measure information includes a page number, a paragraph number, the symbol ID of a left bar line, the symbol ID of a right bar line, a prescribed measure time determined from the meter of musical composition, and a measure number corresponding to a measure.

The prescribed measure time is determined by formula (1).

$$\text{Prescribed measure time} = \text{TimeBase} \times 4/\text{Den} \times \text{Num} \qquad \text{Formula (1)}$$

Here, TimeBase is the number of ticks per quarter note and this shall be 480 in the present embodiment.

Den indicates the denominator (length of one beat) of the meter of the musical composition and Num indicates the numerator (number of beats within a measure) of the musical composition meter (prescribed measure time calculating means 401).

Thereafter, the ChordID, which indicates a group of notes sounded at the same timing, is added (step 43). The ChordID is determined by the positions of the notes in the lateral direction and whether or not the notes are in contact with the same stem.

The TimingNo., which indicates the order of sound emission, is added (step 44). The TimingNo. is determined by the ChordID and the position in the lateral direction.

The GateTime and OnTime are added (step 45). The GateTime is determined by the type of note and number of dots, and the OnTime is determined by the GateTime and TimingNo.

Step 42 to step 45 are performed in accordance with generally-known conventional arts.

Figures 7, 8:
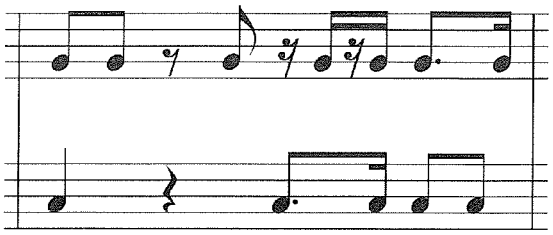
FIG. 7 is an example of a musical score.
FIG. 8 is a table of playing information obtained from respective notes of the musical score example of FIG. 7.

An example of the playing information, ChordID, TimingNo., GateTime, and OnTime, obtained for the musical score of FIG. 7 by the procedure up to step 45 is shown in FIG. 8. In regard to "Note No.," numbers are assigned successively from the left to right of an upper staff of the score and then from the left to right of a lower staff. "Category" indicates whether a symbol is a note or a rest. With the present musical score, the symbols are indicated as notes No. 1 to No. 10 from the left side of the upper staff and as notes No. 11 to No. 16 from the left side of the lower staff.

In the present embodiment, time, such as the GateTime, OnTime, etc., is expressed using ticks. A length of a quarter note is defined as 480 ticks.

Figures 9, 10:
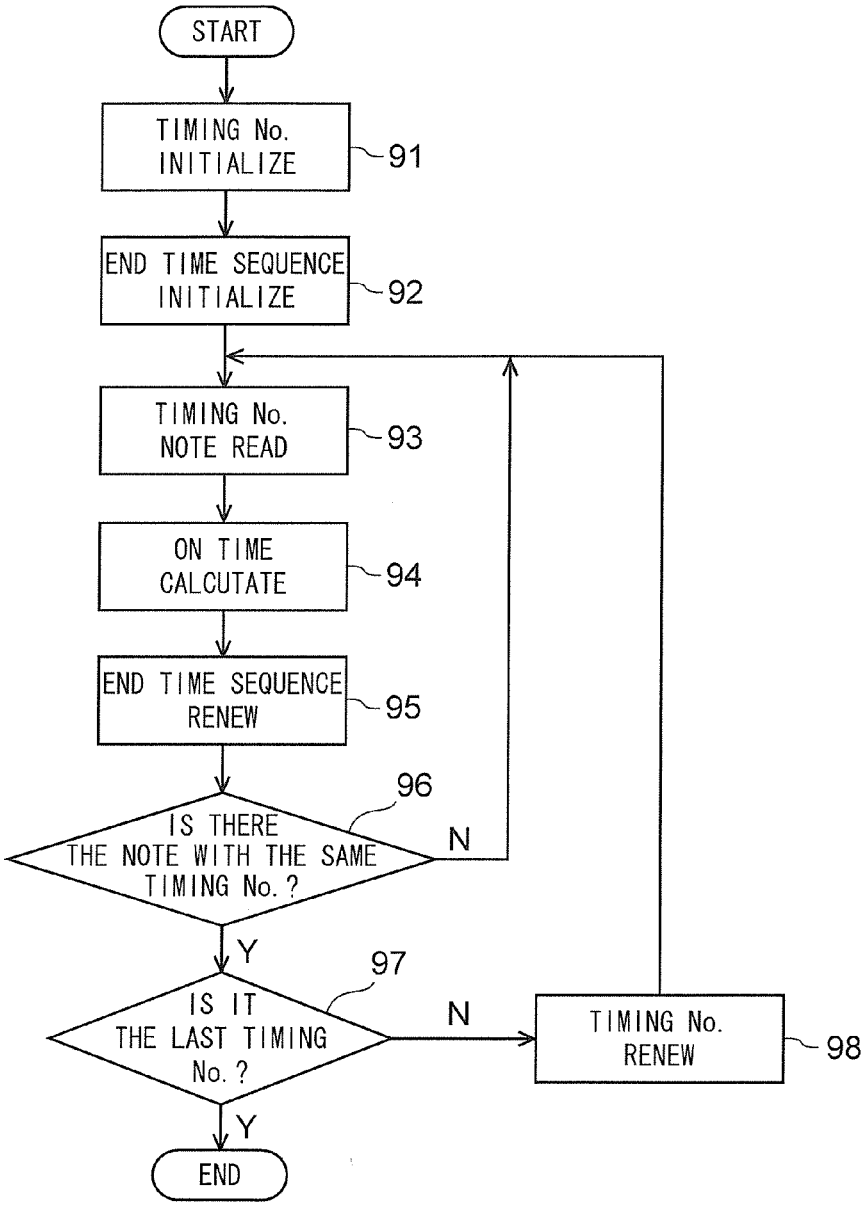
FIG. 9 is a flowchart of a procedure for calculating a measure playing time from a musical score.
FIG. 10 is a model diagram of an example of event types.

A procedure for calculating the OnTime and the measure playing time shall now be described using the musical score of FIG. 7 as an example and with reference to the flowchart of FIG. 9.

The TimingNo. is initialized to 1 (step 91).

An EndTime sequence is initialized (step 92).

The note No. 1 for which TimingNo.=1 is read (step 93).

The OnTime of the note No. 1 is calculated (step 94). OnTime=0 because the TimingNo. is 1.

The EndTime of the note No. 1 is calculated (step 95). The GateTime of the note No. 1 is added to the OnTime of the note No. 1 and thus EndTime=240. This EndTime is added to the EndTime sequence.

A return to step 93 is performed because a note with the same TimingNo. is present (step 96).

The note No. 11 is read (step 93).

The OnTime of the note No. 11 is calculated (step 91). OnTime=0 because the TimingNo. is 1 for this note as well.

The EndTime of the note No. 11 is calculated (step 95). The GateTime of the note No. 11 is added to the OnTime of the note No. 11, and therefore EndTime=480.

The EndTime sequence contains only 240 and does not contain 480, and therefore 480 is also added to the EndTime sequence.

The reading of notes for which TimingNo.=1 is finished, and therefore the TimingNo. is renewed to 2 and the note of the next TimingNo. is read.

The note No. 2 is read (step 93) and the OnTime is calculated (step 94). The OnTime of the note No. 2 is the shortest time in the EndTime sequence. In the present case, it is 240.

The EndTime of the note No. 2 is calculated (step 95). The GateTime of the note No. 2 is added to the OnTime of the note No. 2, and therefore EndTime=480.

480 is already present in the EndTime sequence, and therefore 480 is not added to the EndTime sequence. Further, there is no other note for which TimingNo.=2, and therefore 240, currently assigned to the OnTime of the note No. 2, is deleted from the EndTime sequence.

The TimingNo. is renewed to 3 and the note of the next TimingNo. is read.

The note No. 3 is read (step 93) and the OnTime is calculated (step 94). The OnTime of the note No. 3 is the shortest value in the EndTime sequence. Here, it is 480.

The EndTime of the note No. 3 is calculated (step 95). The GateTime of the note No. 3 is added to the OnTime of the note No. 3 and the EndTime is thus 720. This value is not present in the EndTime sequence, and therefore it is added to the EndTime sequence. This time, there is still present another note for which the TimingNo. is 3, and therefore the TimingNo. is not renewed and 480 in the EndTime sequence is not deleted from the EndTime sequence.

The note No. 12 of the same TimingNo. is read in step 93 and the OnTime is calculated (step 94). The OnTime of the note No. 12 takes on the value of 480, which is the shortest value in the EndTime sequence.

The EndTime of the note No. 12 is calculated (step 95). For the note No. 12, OnTime+GateTime=960. This value is not present in the EndTime sequence, and therefore it is added to the EndTime sequence. There is no other note for which TimingNo.=3, and therefore the smallest value in the EndTime sequence is deleted.

By performing the same process, the calculation of the OnTime and renewal of the EndTime sequence are performed for all notes. The largest value remaining in the EndTime sequence when the process is finished for all notes is the measure playing time.

A characteristic arrangement of the present invention is that tuplet inference in the musical score is performed in step 46 following step 45 to correct the ChordID, TimingNo., GateTime, and OnTime. This portion shall be described in detail later.

The playing information is prepared from the musical score information for which the tuplet inference was performed in step 46 (step 47). The playing information conforms to the MIDI standard format and is arranged from a sequence of the following playing event information.

Note event: Sound emission starting and sound emission stopping events of a note Control event: Events of setting the volume, localization, etc., in a sound emission channel Tone event: Event of designating the tone of a sound emission channel Tempo event: Event of setting a tempo of the musical composition A format of the playing event information is shown in FIG. 10.

An event type is a number that identifies an event as a note event, control event, tempo event, etc.

Data1 contains a number that identifies the musical interval in the case of a note event or identifies the volume, localization, etc., in the case of a control event or is a tempo value in the case of a tempo event.

Data2 contains a sound emission strength (with 0 indicating stoppage of sound emission) in the case of a note event and set values of volume, localization, etc., in the case of a control event.

The time information contains the time (ticks) from the start of the musical composition to the generation of the event.

The channel number contains the channel number subject to control of sound emission, volume, etc.

Figure 11:
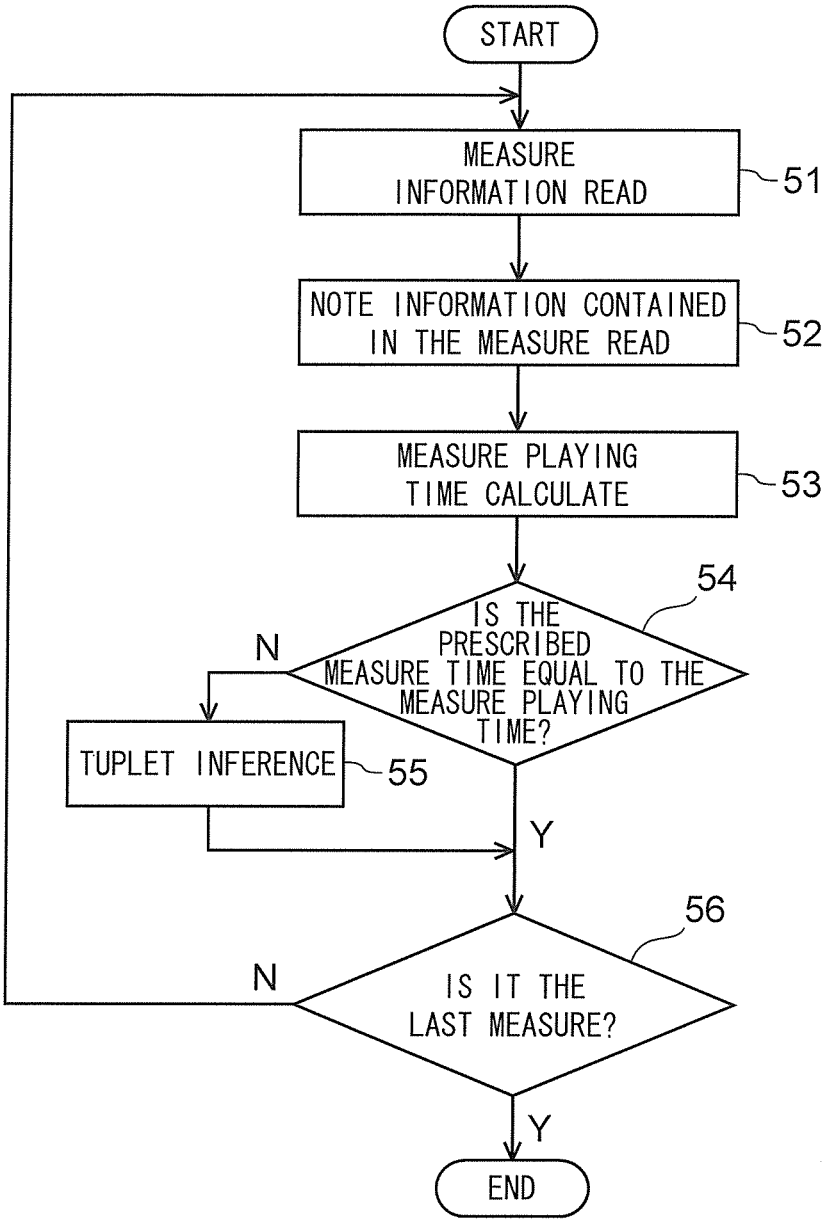
FIG. 11 is a flowchart of an overall flow for performing tuplet inference.

A general flow of step 46 (tuplet inference) shown in FIG. 5 shall now be described with reference to the flowchart of FIG. 11.

First, the measure information prepared in step 42 is read (step 51).

The note information contained in the measure is read and stored in the note sequence (step 52).

The reading concerning notes is performed as follows.

The page information is read based on the page number stored in the measure information.

From the page information, the paragraph information indicated by the paragraph number in the measure information is read.

From the paragraph number, the paragraph-belonging symbol matching the symbol ID of the left bar line in the measure information is read and the lateral direction position of this symbol is set as a measure left end position. Similarly, the paragraph-belonging symbol of the right bar line is read and its position set as a measure right end position.

From the page information, the staff information matching the paragraph number and belonging paragraph ID in the measure information is read. The staff-belonging symbols positioned between the measure left end position and the measure right end position and belonging to the note or rest category are stored in the measure note sequence.

The measure playing time is calculated from the measure note sequence (step 53).

The measure playing time and the prescribed measure time in the measure information are compared (step 54) and if the two are not matched, tuplet inference is performed (step 55). If the measure playing time and the prescribed measure time are matched in step 54, transition to processing of the next measure is performed (step 56).

A detailed procedure of the tuplet inference in step 55 shown in FIG. 11 shall now be described for a case of preparing the playing data shown in FIG. 14 from the musical score of FIG. 13 with reference to the flowchart of FIG. 12.

First, the reference time is set by the reference time setting means 441*a* of the note value correcting means 404 (step 61). The reference time is the time of one beat. The musical composition example of FIG. 13 is in 4/4 meter, and therefore one beat is a quarter note and is 480 ticks.

In a case of 6/8 meter, etc., the reference time is set to the length of three eighth notes. In this case, the reference time is 720 ticks.

The TimingNo. sequence is prepared (step 62). Here, the numbers 1 to 16, corresponding to the upper staff notes No. 1 to No. 12 and the lower staff notes No. 13 to No. 16, are entered.

Initialization or renewal of the index of the TimingNo. is performed (step 63). At the very beginning, the TimingNo. index is 0.

The notes of the TimingNo. indicated by the TimingNo. index are read (step 64). At this point, the notes of the notes No. 1 and No. 13 are read.

Of the notes read, the note of smaller note value (GateTime) is selected (step 65). Here, the note No. 1 is selected.

The selected note is added to a beat group (step 66).

Whether or not grouping is completed is judged according to predetermined conditions described later, and if grouping is completed, the next step 68 is entered while if grouping is not completed, a return to step 63 is performed (step 67).

The conditions of completion of grouping in step 67 are as follows.

In the Case of a Note

There is a beam.

The note is the last note in the measure (A).→Grouping is completed.

Cases Besides the Above

There is a note of the same beam at a later timing (B).→Continue grouping.

There is no note of the same beam at a later timing (C).→Grouping is completed.

There is no beam (D).→Grouping is completed.

In the Case of a Rest

The note is the first note of the beat group (E).→Grouping is competed.

Cases Besides the Above

The note is the last note in the measure (F).→Grouping is completed.

Cases Besides the Above

A note belonging to the beam and preceding the rest is present in the beat group.

The same beam as that of the note is present after the rest (G).→Continue grouping.

Cases besides the above (H)→Grouping is completed.

Cases besides the above (I)→Continue with grouping.

Figure 13:
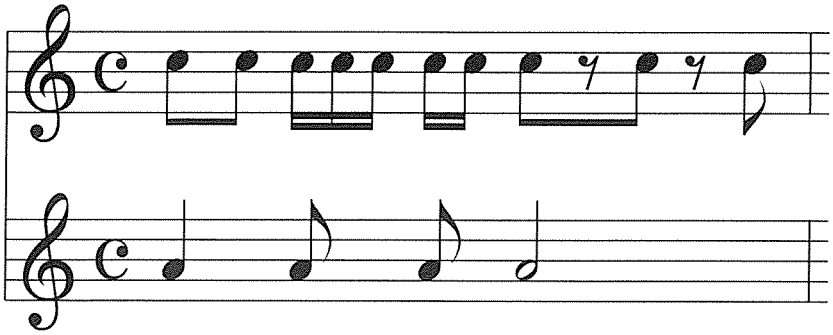
FIG. 13 is an example of a musical score.

In performing grouping on the musical score shown in FIG. 13, first the grouping concerning the note No. 1 is judged. The note No. 1 is a note with a beam and corresponds to a case other than the case of the last note in the measure, a note of the same beam is present at a later timing, and therefore the present case corresponds to the case (B) given above and grouping is continued.

Thereafter, the TimingNo. index is renewed (step 63) and the note No. 2 of the TimingNo. 2 is read (step 64). There is only one note corresponding to the TimingNo. 2, and therefore the note No. 2 is selected (step 65) and added to the beat group (step 66). The note No. 2 is a note with a beam and corresponds to a case other than the case of the last note in the measure, there is no note of the same beam at a later timing, and therefore the condition of the case (C) given above applies and grouping is completed in step 67. The grouping means 443*a* is arranged from step 63 to step 67.

Thereafter, the measure playing time calculating means 402 is used to calculate the playing time of the beat group (step 68). In the present case, there are two eighth notes and the playing time is thus 480 ticks.

The calculated playing time (480 ticks) of the beat group and the reference time (480 ticks, because the present musical score is in 4/4 meter and one beat is a quarter note) are then compared (step 69). With the present beat group, the playing time and the reference time are equal and the beat group process is thus completed upon judging that the group is not a tuplet. If the beat group process is completed, the beat group is initialized (step 70) and transition to the process of step 63 is performed for grouping of the next beat group.

Thereafter, the TimingNo. index is renewed (step 63) and the notes No. 3 and No. 14 of the TimingNo. 3 are read (step 64). The note No. 3, which is smaller in note value, is selected (step 65) and added to the beat group (step 66). The note No. 3 is a note with a beam and corresponds to a case other than the case of the last note in the measure, there is a note of the same beam at a later timing, and therefore in step 67, transition to the process of step 63 is performed by the condition of (B).

The TimingNo. index is renewed (step 63) and the note No. 4 of the Timing No. 4 is read (step 64) and added to the beat group (step 66). The note No. 4 is a note with a beam and corresponds to a case other than the case of the last note in the measure, there is a note of the same beam at a later timing, and therefore in step 67, transition to the process of step 63 is performed by the condition of (B).

The TimingNo. index is renewed (step 63) and the note No. 5 of the Timing No. 5 is read (step 64) and added to the beat group (step 66). The note No. 5 is a note with a beam and corresponds to a case other than the case of the last note in the measure, there is no note of the same beam at a later timing, and therefore in step 67, the condition of (C) applies and the grouping is completed.

Thereafter, the playing time of the beat group is calculated (using the measure playing time calculating means) (step 68). In the present case, there are three sixteenth notes and the playing time is thus 360 ticks.

The calculated playing time (360 ticks) of the beat group and the reference time (480 ticks, because the present musical score is in 4/4 meter and one beat is a quarter note) are then compared (step 69). With the present beat group, the playing time and the reference time are not equal, and therefore step 71 is entered.

In step 71, it is judged whether or not the playing time (360 ticks) of the beat group is shorter than the reference time (480 ticks), and if the playing time is shorter than the reference time, a process for the shorter case is performed (step 72).

In step 72, a process for a case where the playing time of the beat group is an eighth note (240) is performed.

In the present embodiment, a case of a triplet of sixteenth notes, which is often used in musical compositions, shall be described. Here, the process is performed according to conditions such as the following.

(P) The number of notes in the beat group is 3.

An eighth note processing flag is inverted.

The tupleting process is performed (step 73), the beat group is initialized (step 74), and step 63 is entered. The detailed procedure of the tupleting process in step 73 shall be described later.

(Q) The number of notes in the beat group is 2 and the playing time is equal to an eighth note.

The eighth note processing flag is inverted.

The beat group initializing process is performed (step 75) and step 63 is entered.

(R) The number of notes in the beat group is one, the note is an eighth note, and the eighth note processing flag is true.

The eighth note processing flag is set to false.

The beat group initializing process is performed (step 75), and step 63 is entered.

(S) Case not corresponding to any of (P) to (R)

Step 63 is entered without performing the beat group initializing process and the next note is added to the beat group.

Although with the present embodiment, the case where there are three sixteenth notes was described, the same process is also performed in a case where there are five or seven thirty-second notes, a case where there are ten sixty-fourth notes, etc.

Figure 15:
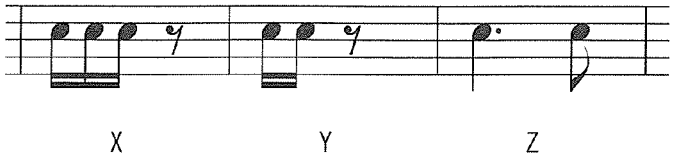
FIG. 15 is an example of a musical score.

The process of the eighth note processing flag in step 72 is performed to establish a solitary eighth rest after a beam, as in X and Y in FIG. 15, etc., as a beat group.

In the present case (note Nos. 3, 4, and 5 in the musical score of FIG. 13), the condition (number of notes is 3) of (P) above applies, and therefore the eighth note processing flag is inverted (set to false in the present case), the tupleting process is performed (step 73), the beat group is initialized (step 74), and step 63 is entered.

In step 73, in which the tupleting process is performed by means of the note value correcting means 404, the GateTime of the grouped notes are changed (tupleted) by the following procedure.

First, the notes of the same GateTime in the beat group are grouped together as a tuplet group.

The total GateTime value of all notes of the tuplet is set as follows in accordance with the number of notes in the tuplet group.

The number of notes is 3→2 times the GateTime of each note of the tuplet group

The number of notes is 5 to 7→4 times the GateTime of each note of the tuplet group The number of notes is 9 to 15→8 times the GateTime of each note of the tuplet group The number of notes is 17 to 31→16 times the GateTime of each note of the tuplet group Cases where the number of notes is 2, 4, 8, or 16 are exempt from the tupleting process because the note value can be expressed by a normal note (a note that is not a tuplet) in these cases.

In a case of a triple system of a 6/8 meter, etc., the total GateTime value of all notes of the tuplet is set as follows.

The number of notes is 2→1 time the GateTime of each note of the tuplet group

The number of notes is 4 to 5→2 times the GateTime of each note of the tuplet group The number of notes is 7 to 11→4 times the GateTime of each note of the tuplet group The number of notes is 12 to 23→8 times the GateTime of each note of the tuplet group The number of notes is 25 to 47→16 times the GateTime of each note of the tuplet group In cases of a triple system of a 6/8 meter, etc., cases where the number of notes is 3, 6, 9, or 24 are exempt from the tupleting process because the note value can be expressed by a normal note (a note that is not a tuplet) in these cases.

The GateTime of each note of the tuplet group is calculated by the following formulae.

The GateTime of a note other than the last note of the tuplet group is calculated by formula (2).

$$\text{GateTime}=\text{Total GateTime}\div\text{Number of notes in tuplet} \quad \text{Formula (2)}$$

The GateTime of the last note of the tuplet group is calculated by formula (3).

$$\text{GateTime}=\text{Total GateTime}-(\text{Total GateTime Number of notes in tuplet})\times(\text{Number of notes in tuplet}-1) \quad \text{Formula (3)}$$

The GateTime of just the last note is calculated by formula (3) to accommodate for a case where the total GateTime is not evenly divisible by the number of notes making up the tuplet group.

In the present case, the note No. 3 to note No. 5 are grouped together in a tuplet group and tupleted.

That is, the note No. 3 to note No. 5 are sixteenth notes, and therefore the GateTime (before conversion) of the tuplet group is 120, and the total GateTime, by the calculation method described above, is 240, which is 2 times the GateTime of each note of the tuplet group, because the number of notes is 3. Also, by formula (2) and formula (3), the GateTime of each note after the change is 80.

After the tupleting process has been performed, the beat group is initialized (step 74) and step 63 is entered to perform the process for the next note.

In the same manner as in the procedure up to now, the note No. 6 and the note No. 7 are read (step 64) and registered in the beat group (step 66).

After grouping is completed (step 67), the playing time of the beat group is calculated (using the measure playing time calculating means) in step 68. In the present case, there are two sixteenth notes in the beat group and the playing time is thus 240.

The playing time (240) of the beat group is shorter than the reference time (480), and therefore transition to the process of step 72 is performed (step 71).

With the process for the shorter case (step 72), the condition (the number of notes in the beat group is 2 and the playing time is equal to an eighth note) of (Q) described above applies, and therefore tupleting is not performed, the beat group is initialized (step 75), and transition to the process of step 63 is performed.

Thereafter, the note No. 8 and note No. 16 are read (step 64). The note No. 8 is selected in step 65 and added to the beat group in step 66.

The condition (B) applies in step 67, and therefore transition to the process of step 63 is performed and the next note is read.

The note No. 9 is read (step 64) and added to the beat group (step 66). The condition (G) applies in step 67, and therefore transition to the process of step 63 is performed and the next note is read.

The note No. 10 is read (step 64) and added to the beat group (step 66). The condition (C) applies in step 67, and therefore the grouping is ended.

In step 68, the playing time of the beat group is calculated. In this case, the playing time is 240×3 and thus 720.

The playing time and the reference time are compared and transition to step 71 is performed because these are not equal (step 69).

In step 71, the playing time (720) and the reference time (480) are compared and transition to step 76 is performed because the playing time is longer than the reference time.

In step 76, it is checked whether or not the beat group contains a note longer than the reference time (quarter note). There is no such note in the present case, and therefore the tupleting process is performed (step 73).

In the tupleting process (step 73), the note No. 8 to note No. 10 are grouped together as a tuplet group. The notes in the tuplet group are eighth notes, the total GateTime is that for the case where the number of notes is 3 and is thus 480, which is 2 times an eighth note (240), and by formula (2) and formula (3), the GateTime of each note in the tuplet group after is 160. When the tupleting process is ended, the beat group is initialized (step 74) and a return to step 63 is performed.

Note No. 11 is read (step 64) and added to the beat group (step 66). In step 67, grouping is completed in accordance with the condition (D), and the playing time of the beat group is calculated in step 68. In the present case, the playing time is 240.

The playing time (240) and the reference time (480) are compared in step 69 and step 71 is entered because the two are not equal.

In step 71, the playing time (240) and the reference time (480) are compared and step 72 is entered to perform the process for the shorter case because the playing time is shorter than the reference time.

In step 72, the condition (none of (P) to (R) applies) of (S) applies, and therefore step 63 is entered.

Note No. 12 is read (step 64) and added to the beat group (step 66). In step 67, grouping is completed in accordance with the condition (F).

The playing time of the beat group is calculated in step 68. In the present case, the playing time is 480.

The playing time (480) and the reference time (480) are compared in step 69 and the beat group is initialized (step 70) and step 63 is entered because the playing time and the reference time are equal.

Figure 16:
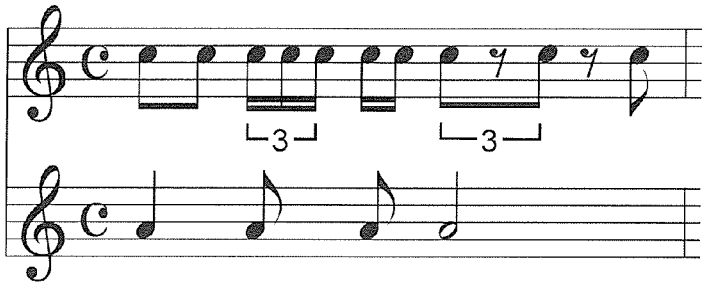
FIG. 16 is an example of a musical score in which correct tuplet symbols are indicated for the musical score example of FIG. 13.

In step 63, the process is ended because the process has been completed for all Timing No. (No. 1 to 12) in the musical score of FIG. 13. It can be understood that when tuplet numbers are correctly expressed in the musical score of FIG. 13 by performing the tupleting process, the musical score will be as shown in FIG. 16.

Figure 12:
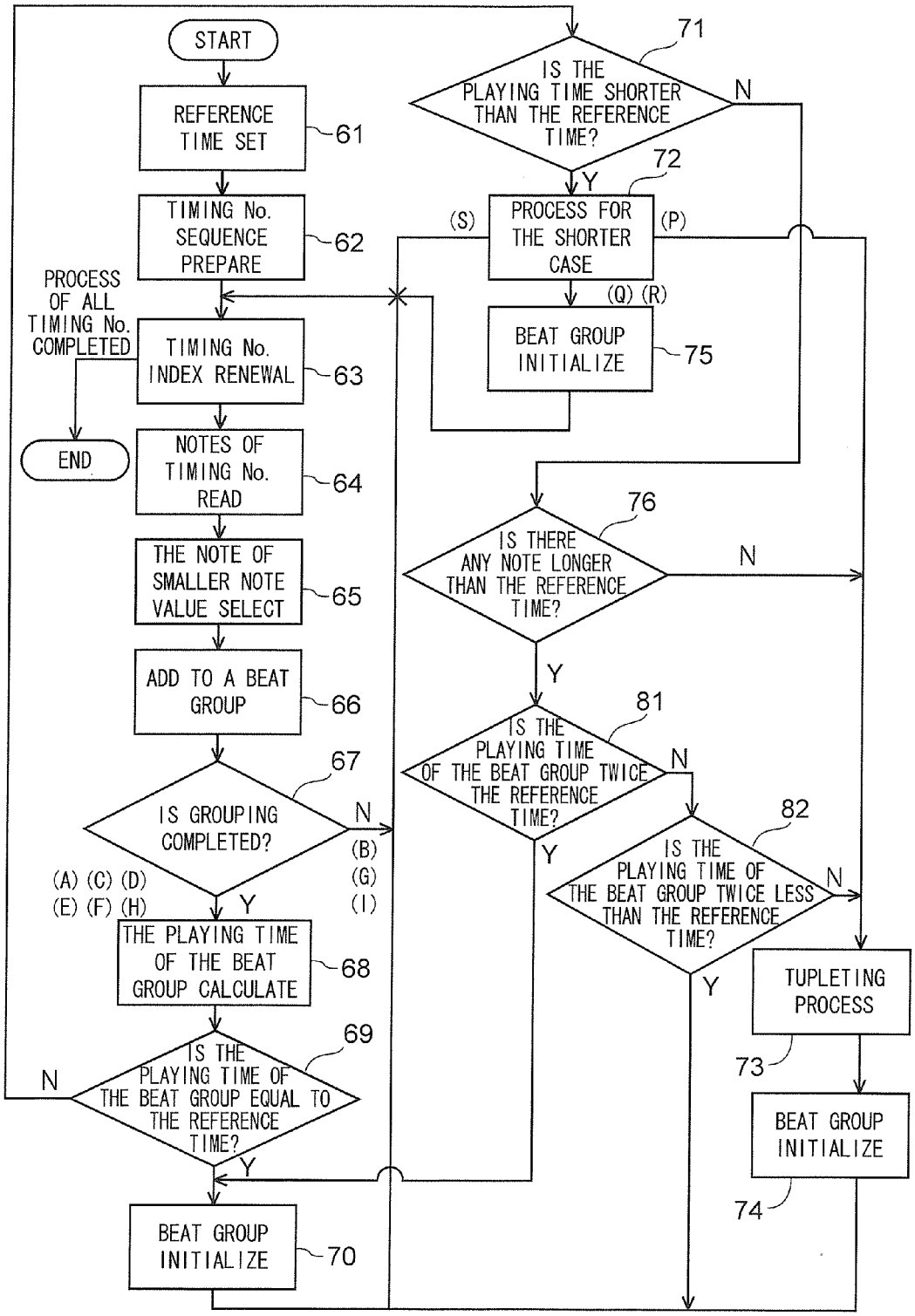
FIG. 12 is a flowchart of a detailed procedure for performing tuplet inference.

Also, step 81 and step 82 in the flowchart of FIG. 12 is for accommodating a musical score (dotted note) such as that of Z in FIG. 15.

When a dotted quarter note is read into the beat group, the playing time of the doted quarter note is 720, which is 1.5 times the playing time of a quarter note.

Step 76 is entered from step 71 because the playing time (720) is longer than the reference time (480). From step 76, step 81 is entered because there is a note (720) that is longer than the reference time (480).

In step 81, the playing time (720) and the reference time (480) are compared, and step 82 is entered because the playing time is not twice the reference time.

In step 82, the playing time (720) and the reference time (480) are compared, and step 63 is entered to renew the TimingNo. because the playing time (720) is less than twice the reference time (480).

In step 64, the next eighth note is read and added to the beat group.

In step 67, grouping is completed because the condition (D) applies, and the playing time is calculated in step 68. In the present case, the playing time is 960 (720+240).

By step 69 to step 81, the playing time (960) is twice the reference time (480), and therefore from step 81, step 70 is entered and the process is finally ended without performing tupleting.

With the tupleting process described above, the tupleting process of changing the note values of the grouped notes is performed in the following cases (1) to (3).

(1) If the playing time of the grouped notes is longer than the reference time of one beat and there is no note longer than the reference time within the group (in the case of No in step 76)

(2) If the playing time of the grouped notes is shorter than the reference time of one beat and the number of notes in the group is 3 (in the case where the condition (P) is met in step 72)

(3) If there is a note longer than the reference time among the grouped notes and the playing time exceeds twice the reference time (in the case of No in step 82)

Therefore, with the exception of a case where the playing time of the grouped notes is equal to the reference time of one beat, tuplet inference of a plurality of notes connected by a beam (grouped notes) can be performed to perform processing to correct note values in both the case where the playing time is shorter than the reference time and the case where the playing time is longer than the reference time. In this process, processing can be performed in accordance with any of various tuplets, such as a triplet, quintuplet, septuplet, decuplet, etc.

An embodiment of a musical score playing device that is specialized to triplets in preparing playing information having the correct note values and thereby enables automatic playing shall now be described.

As with the musical score playing device described above, the musical score playing device that performs a tupleting process specialized to triplets is arranged from the respective elements of the block diagram of FIG. 1 and its hardware arrangement is as shown in FIG. 2. Also, the musical score information storage means 3 is arranged from the respective means of FIG. 3. The functions that the respective arrangements have are the same in content as those of the musical score playing device described above and description thereof shall thus be omitted.

Figure 17:
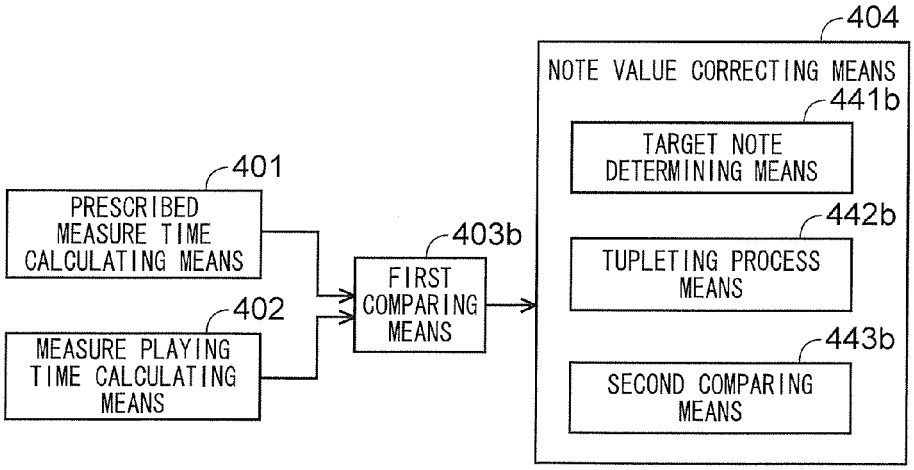
FIG. 17 is a functional block diagram of an arrangement of a playing information preparing means.

As shown in FIG. 17, the playing information preparing means 4 of the musical score playing device that performs the tupleting process specialized to triplets includes the prescribed measure time calculating means 401 calculating the prescribed measure time from the meter of a musical composition, the measure playing time calculating means 402 calculating the measure playing time from the sound emission timings and note values (GateTime) of notes and rests within a measure, a first comparing means 403*b* comparing the calculated prescribed measure time and measure playing time, and the note value correcting means 404 inferring that a tuplet is present within the measure if the prescribed measure time and the measure playing time are not matched and correcting the sound emission timings and note values of the notes and rests.

The note value correcting means 404 includes a target note determining means 441*b* that successively determines a correction target note and a tupleting process means 442*b* changing the note value of each correction target note in the measure to ⅔ and performing a tupleting process. The tupleting process means 442*b* includes a corrected playing time calculating means calculating the measure playing time from the changed note values, and the prescribed measure time and the corrected measure playing time that is in accordance with the changed note values are compared at a second comparing means 443*b*.

Arrangements are made so that the tupleting process by the tupleting process means 442*b* and the comparison by the second comparing means 443*b* are repeated for the respective correction target notes and the tupleting of a triplet with the changed note values of the respective notes is finalized when the prescribed measure time and the corrected measure playing time become equal.

Even in the musical score playing device that performs the tupleting process specialized to triplets, the respective processes of preparation of the playing information by the playing information preparing means 4 (FIG. 5) and the calculation of the playing time from the musical score (FIG. 9) are performed.

In performing the tuplet inference process specialized to triplets (FIG. 11), the measure playing time is calculated from the measure note sequence by the measure playing time calculating means 402 (step 53).

The measure playing time and the prescribed measure time calculated from the measure information by the prescribed measure time calculating means 401 are compared at the first comparing means 403*b* (step 54), and if the two are not matched, tuplet inference is performed (step 55). If the measure playing time and the prescribed measure time are matched in step 54, transition to processing of the next measure is performed (step 56).

Figure 18:
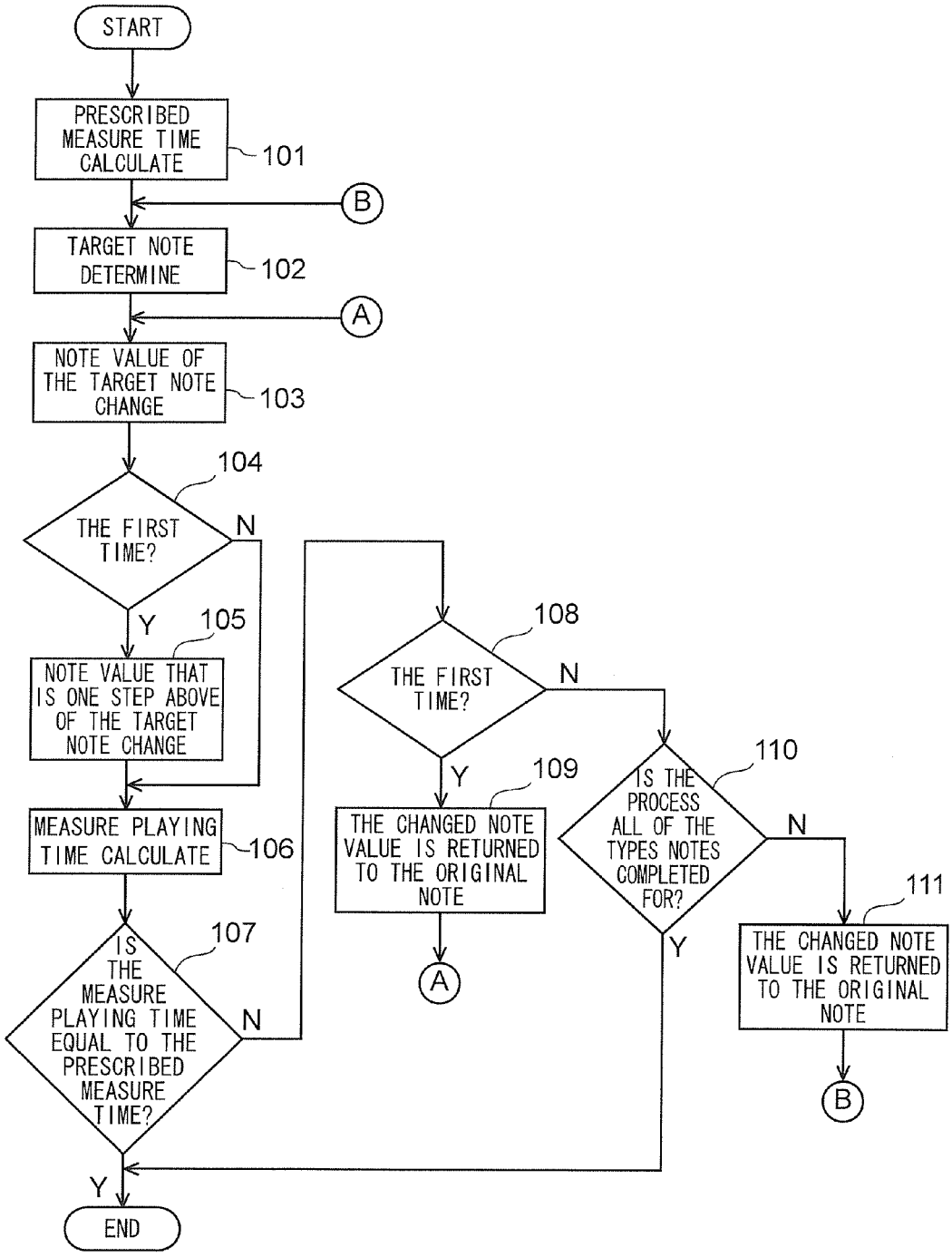
FIG. 18 is a flowchart of a detailed procedure for performing tuplet inference.

With the musical score playing device specialized to triplets, the procedure for tuplet inference differs from that of the musical score playing device described above. The detailed procedure for tuplet inference in step 55 shown in FIG. 11 shall now be described with reference to the flowchart of FIG. 18. A case where the playing information shown in FIG. 20 is prepared from the musical score of FIG. 19 shall be described as an example.

In performing the tupleting process, the tuplet inference is performed repeatedly while changing the target note to be tupleted in the order of a sixty-fourth note, thirty-second note, sixteenth note, eighth note, quarter note, and half note.

The tuplet inference is performed in the order from a sixty-fourth note to a half note because normally in a musical composition, tuplets of notes of small note value tend to be used more frequently than tuplets of notes of large note value.

Also, for a single target note, the tuplet inference is performed twice, that is, once for a case where the note value is changed to that which is one step greater (for example, from a quarter note to a half note) and once for a case where the note value is not changed. By changing the note value to that which is one step greater than that of the target note (for example, from a quarter note to a half note), a triplet arranged from different notes can be judged.

Figure 19:
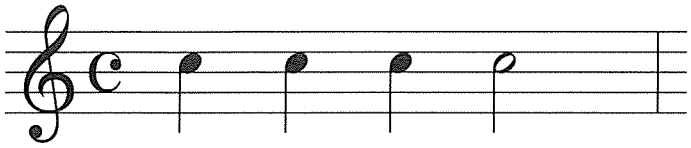
FIG. 19 is an example of a musical score.

With the musical score of FIG. 19, there are no applicable notes for cases where the target note is a sixty-fourth note to an eighth note, and therefore the first note that is made a target note is a quarter note.

First, the prescribed measure time is calculated (step 101). The present musical score is in 4/4 meter and, by formula (1) described above, the prescribed measure time is 1920.

The note that is to be the target note is determined as a quarter note by the target note determining means 441*b* (step 102) and, by the tupleting process means 442*b*, the note value 480 of all quarter notes in the measure is changed to a note value of ⅔, that is, to 320 (step 103).

If the change of note values of the target notes is performed for the first time (step 104), the note value of a half note, which has a note value that is one step above that of a quarter note, is also changed (step 105). The note value of a half note is converted to 640, which is a note value of ⅔ of the note value 960.

The measure playing time for the corrected note values is calculated by the corrected playing time calculating means of the tupleting process means 442*b* (step 106). In this case, there are three note values of 320, which makes 960, and 640 is added thereto so that the measure playing time is 1600.

The measure playing time (1600) and the prescribed measure time (1920) are compared by the second comparing means 443*b* (step 107). Step 108 is entered because the measure playing time (1600) does not match the prescribed measure time (1920).

In step 108, the change of note value is performed for the first time, and therefore step 109 is entered, the changed note values are returned to the original values and then step 103 is entered.

In step 103, the note values are changed again from 480 to 320. This is the second time that the note values are changed, and therefore the measure playing time is calculated by the corrected playing time calculating means in step 106 without performing step 105. In this case, there are three note values of 320, which makes 960, and 960 (the unchanged note value) is added thereto so that the measure playing time is 1920 and the process is ended because this matches the prescribed measure time (1920) (step 107).

In a case of a musical score for which the playing time and the prescribed measure time are not matched in step 107 of the second time, step 110 is entered from step 108 to judge whether or not the process has been completed for all of the types of notes, and if it has been completed, the process is ended. If the process has not been completed for all of the types of notes, the changed note value is returned to the original value and a transition to step 102 is performed (step 111) to change the target note and perform the above process again.

Figure 21:
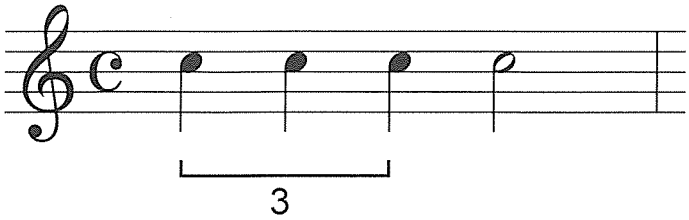
FIG. 21 is an example of a musical score in which correct tuplet symbols are indicated for the musical score example of FIG. 19.

With the musical score of FIG. 19, the presence of a triplet is determined by the changing of the note values of the quarter notes, and the playing information of FIG. 20, resulting from tupleting processing by change of the note values of the note No. 1 to note No. 3, is prepared. A musical score, with which the correct tuplet is indicated, is that in which the tuplet symbol "3" is indicated at the triplet of quarter notes as shown in FIG. 21.

A case where tupleting is performed on the musical score of FIG. 22 to prepare the playing information of FIG. 23 shall now be described.

There are no applicable notes for cases where the target note is a sixty-fourth note to an eighth note, and therefore the first note that is made a target note is a quarter note with the present musical score as well.

First, the prescribed measure time is calculated (step 101). The present musical score is in 4/4 meter and, by formula (1) described above, the prescribed measure time is 1920.

The note that is to be the target note is determined as a quarter note (step 102) and the note value 480 of all quarter notes in the measure is changed to a note value of ⅔, that is, to 320 (step 103).

If the change of note value of the target notes is performed for the first time (step 104), the note value of a half note, which has a note value that is one step above that of a quarter note, is also changed (step 105). The note value of a half note is converted to 640, which is a note value of ⅔ of the note value 960.

The measure playing time with the corrected note values is calculated by the corrected playing time calculating means of the tupleting process means 442*b* (step 106). In this case, there are four note values of 320, which makes 1280, and 640 is added thereto so that the measure playing time is 1920.

The measure playing time (1920) and the prescribed measure time (1920) are compared (step 107). The measure playing time (1920) matches the prescribed measure time (1920) (step 107), and therefore the process is ended.

Figure 22:
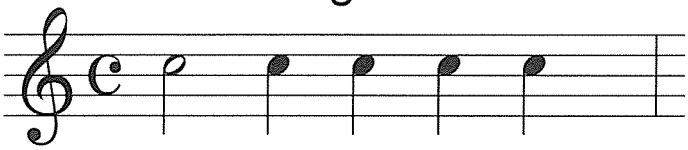
FIG. 22 is an example of a musical score.

With the musical score of FIG. 22, the tupleting-processed playing information of FIG. 23 is prepared by the change of the note values of the note No. 1 to note No. 5, and therefore the presence of two triplets is determined by the changing of the note values of the four quarter notes and the half note.

Figure 24:
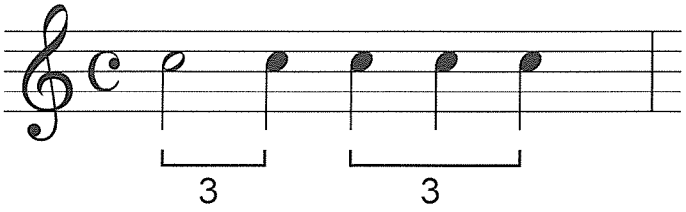
FIG. 24 is an example of a musical score in which correct tuplet symbols are indicated for the musical score example of FIG. 22.
Figure 25:
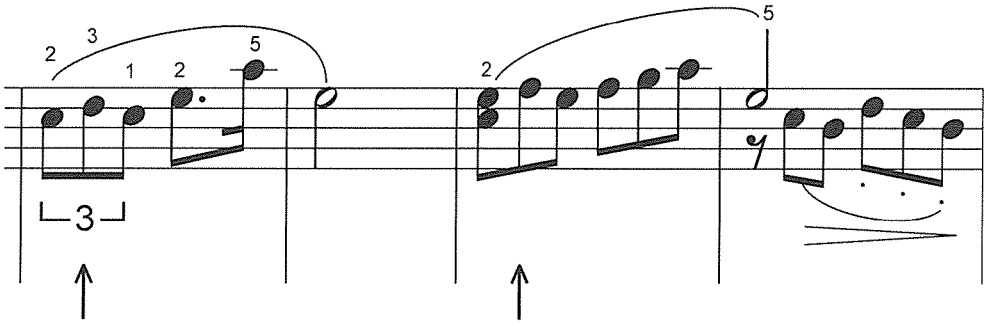
FIG. 25 is an example of a musical score.

Therefore with a musical score, with which the correct tuplets are indicated, the tuplet symbol "3" is indicated at the triplet of the half note and the quarter note and at the subsequent triplet of quarter notes as shown in FIG. 24.

By the tupleting process described above, the tupleting process specialized to triplets, which are most frequently used in musical scores, can be performed and inference of a triplet of a half note that is not joined by a beam or a triplet of quarter notes, etc., is enabled.

The invention claimed is:

1. A musical score playing device comprising:

a prescribed measure time calculating means for calculating a prescribed measure time from the meter of a musical composition;

a measure playing time calculating means for calculating a measure playing time from sound emission timings and note values of notes and rests within a measure;

a comparing means comparing the calculated prescribed measure time and measure playing time; and a note value correcting means for inferring that a tuplet is present within the measure when the prescribed measure time and the measure playing time are not matched and correcting the sound emission timings and note values of the notes and rests, wherein the note value correcting means includes:

a measure note sequence recording means for storing a note sequence within the measure, a grouping means for grouping the notes within the measure according to each beat, and a tupleting process means for performing a tupleting process of changing the note values of the grouped notes when a playing time of the grouped notes and a reference time of a single beat that is calculated from the note sequence are not matched.

2. The musical score playing device according to claim 1, wherein the tupleting process means changes the note values of the grouped notes to perform the tupleting process when the playing time of the grouped notes is longer than the reference time of one beat and there is no note longer than the reference time within the group or when there is a note longer than the reference time among the grouped notes and the playing time exceeds twice the reference time.

3. The musical score playing device according to claim 1, wherein the tupleting process means changes the note values of the grouped notes to perform the tupleting process when the playing time of the grouped notes is shorter than the reference time of one beat and the number of sixteenth notes in the group is 3, or the number of thirty-second notes is 5 or 7.

4. The musical score playing device according to claim 2, wherein the tupleting process by the tupleting process means changes a total note value for the number of grouped notes to a duration obtained by multiplying a total duration of the note values of the grouped notes by a number set in advance in accordance with the number of notes grouped.

5. The musical score playing device according to claim 3, wherein the tupleting process means changes a total note value for the number of grouped notes to a duration obtained by multiplying a total duration of the note values of the grouped notes by a number set in advance in accordance with the number of notes grouped.

6. The musical score playing device according to claim 4, wherein the total note value for the number of notes is changed to a duration that is 2 times the total duration of the note values of the grouped notes when the number of notes grouped is 3, to a duration that is 4 times the total duration of the note values of the grouped notes when the number of notes grouped is 5 to 7, to a duration that is 8 times the total duration of the note values of the grouped notes when the number of notes grouped is 9 to 15, or to a duration that is 16 times the total duration of the note values of the grouped notes when the number of notes grouped is 17 to 31.

7. The musical score playing device according to claim 5, wherein the total note value for the number of notes is changed to a duration that is 2 times the total duration of the note values of the grouped notes when the number of notes grouped is 3, to a duration that is 4 times the total duration of the note values of the grouped notes when the number of notes grouped is 5 to 7, to a duration that is 8 times the total duration of the note values of the grouped notes when the number of notes grouped is 9 to 15, or to a duration that is 16 times the total duration of the note values of the grouped notes when the number of notes grouped is 17 to 31.

8. A musical score playing method comprising:

calculating a prescribed measure time from the meter of a musical composition, by one or more processors;

calculating a measure playing time from sound emission timings and note values of notes and rests within a measure, by said one or more processors;

comparing the calculated prescribed measure time and measure playing time, by said one or more processors; and when the prescribed measure time and the measure playing time are not matched, determining by said one or more processors; that a tuplet is present within the measure, storing a note sequence within the measure, grouping the notes within the measure according to each beat, and when a playing time of the grouped notes and a reference time of a single beat that is calculated from the note sequence are not matched, changing, by said one or more processors, the note values of the grouped notes to correct the sound emission timings and note values of the notes and rests.

9. The musical score playing method according to claim 8, wherein said changing further comprises changing the note values of the grouped notes when the playing time of the grouped notes is longer than the reference time of one beat and there is no note longer than the reference time within the group, or when there is a note longer than the reference time among the grouped notes and the playing time exceeds twice the reference time.

10. The musical score playing method according to claim 8, wherein said changing further comprises changing the note values of the grouped notes when the playing time of the grouped notes is shorter than the reference time of one beat and the number of sixteenth notes in the group is 3, or the number of thirty-second notes is 5 or 7.

11. The musical score playing method according to claim 9, wherein said changing further comprises changing note value for the number of grouped notes to a duration obtained by multiplying a total duration of the note values of the grouped notes by a number set in advance in accordance with the number of notes grouped.

12. The musical score playing method according to claim 10, wherein said changing further comprises changing a total note value for the number of grouped notes to a duration obtained by multiplying a total duration of the note values of the grouped notes by a number set in advance in accordance with the number of notes grouped.

13. The musical score playing method according to claim 11, wherein the total note value for the number of notes is changed to a duration that is 2 times the total duration of the note values of the grouped notes when the number of notes grouped is 3, to a duration that is 4 times the total duration of the note values of the grouped notes when the number of notes grouped is 5 to 7, to a duration that is 8 times the total duration of the note values of the grouped notes when the number of notes grouped is 9 to 15, or to a duration that is 16 times the total duration of the note values of the grouped notes when the number of notes grouped is 17 to 31.

14. The musical score playing method according to claim 12, wherein the total note value for the number of notes is changed to a duration that is 2 times the total duration of the note values of the grouped notes when the number of notes grouped is 3, to a duration that is 4 times the total duration of the note values of the grouped notes when the number of notes grouped is 5 to 7, to a duration that is 8 times the total duration of the note values of the grouped notes when the number of notes grouped is 9 to 15, or to a duration that is 16 times the total duration of the note values of the grouped notes when the number of notes grouped is 17 to 31.

15. A musical score playing device comprising:

a prescribed measure time calculating means for calculating the prescribed measure time from the meter of a musical composition;

a measure playing time calculating means for calculating a measure playing time from sound emission timings and note values of notes and rests within a measure;

a first comparing means for comparing the calculated prescribed measure time and measure playing time; and a note value correcting means for inferring that a tuplet is present within the measure when the prescribed measure time and the measure playing time are not matched and correcting the sound emission timings and note values of the notes and rests, wherein the note value correcting means includes:

a target note determining means that successively determines a correction target note, a tupleting process means for performing a tupleting process of changing the note value of each correction target note in the measure to ⅔, and a second comparing means for comparing the prescribed measure time and a corrected measure playing time that is in accordance with the changed note values, wherein the tupleting process and the comparison by the second comparing means are repeated for respective target notes and the tupleting of a triplet is finalized with the changed note values of the respective notes at the point at which the prescribed measure time and the corrected measure playing time are equal.

16. The musical score playing device according to claim 15, wherein the tupleting process means performs two types of tuplet inference by performing a tupleting process upon changing the note value of a note, having a note value one step greater than the correction target note in the measure, to ⅔ of the note value.

17. The musical score playing device according to claim 15, wherein the target note determining means performs the inferring that a tuplet is present by the tupleting process means repeatedly while changing the target note in the order of a sixty-fourth note, thirty-second note, sixteenth note, eighth note, quarter note, and half note.

18. A musical score playing method comprising:

calculating the prescribed measure time from the meter of a musical composition, by one or more processors;

calculating the measure playing time from sound emission timings and note values of notes and rests within a measure, by said one or more processors;

comparing the calculated prescribed measure time and measure playing time and, when the prescribed measure time and the measure playing time are not matched, inferring that a tuplet is present within the measure, by one or more processors;

determining a correction target note with respect to the notes in the measure, by one or more processors; and changing the note value of the correction target note in the measure to ⅔, comparing the prescribed measure time and a corrected measure playing time that is in accordance with the changed note values, and finalizing the tupleting of a triplet with the changed note values of a respective notes at the point at which the prescribed measure time and the corrected measure playing time are equal, by one or more processors, wherein said changing the note value, comparing and finalizing are performed repeatedly on the respective target notes.

19. The musical score playing method according to claim 18, wherein after the correction target note has been determined, the note value of the correction target note has been changed and the change of the note value has been performed for a first time, said changing the note value, comparing and finalizing are performed upon changing the note value of a note, having a note value that is one step greater than the correction target note in the measure, to ⅔ of the note value.

20. The musical score playing method according to claim 18, wherein said changing the note value, comparing and finalizing are performed repeatedly while changing the target note in the order of a sixty-fourth note, thirty-second note, sixteenth note, eighth note, quarter note, and half note.

* * * * *